US009593612B2

(12) United States Patent
Takatsu et al.

(10) Patent No.: US 9,593,612 B2
(45) Date of Patent: Mar. 14, 2017

(54) INTERNAL COMBUSTION ENGINE

(71) Applicant: ISUZU MOTORS LIMITED, Tokyo (JP)

(72) Inventors: Hidehisa Takatsu, Aysae (JP); Atsushi Yamamoto, Fujisawa (JP); Jun Nakano, Sagamihara (JP); Shigeki Murakami, Ayase (JP)

(73) Assignee: ISUZU MOTORS LIMITED, Tokyo (JP)

( * ) Notice: Subject to any disclaimer, the term of this patent is extended or adjusted under 35 U.S.C. 154(b) by 0 days.

(21) Appl. No.: 14/384,744

(22) PCT Filed: Mar. 19, 2013

(86) PCT No.: PCT/JP2013/057799
§ 371 (c)(1),
(2) Date: Oct. 20, 2014

(87) PCT Pub. No.: WO2013/141233
PCT Pub. Date: Sep. 26, 2013

(65) Prior Publication Data

US 2015/0089932 A1 Apr. 2, 2015

(30) Foreign Application Priority Data

Mar. 22, 2012 (JP) ..... 2012-065949

(51) Int. Cl.
*F01N 3/20* (2006.01)
*F01N 1/02* (2006.01)
(Continued)

(52) U.S. Cl.
CPC ..... *F01N 3/20* (2013.01); *F01N 1/02* (2013.01); *F01N 1/083* (2013.01); *F01N 1/085* (2013.01);
(Continued)

(58) Field of Classification Search
CPC .... F01N 13/10; F01N 13/102; F01N 13/1811; F01N 13/08; F01N 13/14; F01N 13/1816
(Continued)

(56) References Cited

U.S. PATENT DOCUMENTS 4,206,178 A * 6/1980 Oya et al. ..... 422/176
4,745,742 A * 5/1988 Nada et al. ..... 60/276
(Continued)

FOREIGN PATENT DOCUMENTS

DE 102009014179 A1 12/2010
EP 1 612 383 A2 1/2006
(Continued)

OTHER PUBLICATIONS

Patent Abstracts of Japan, Publication No. 09-137720, published May 27, 1997.
(Continued)

*Primary Examiner* — Patrick Maines
(74) *Attorney, Agent, or Firm* — Staas & Halsey LLP

(57) ABSTRACT

The phenomenon of resonance in a catalyst converter due to a flow of an exhaust gas is reduced without causing problems with vehicle layout, problems with manufacturing (higher manufacturing cost), or adverse influences on other facets of performance. An internal combustion engine includes an internal combustion engine main body having a fuel chamber formed in an interior, and a catalyst converter arranged in an exhaust flow channel of the internal combustion engine main body and provided with a catalyst for purifying the exhaust gas. The exhaust flow channel, which is upstream of the catalyst of the catalyst converter, is provided with a protuberance for disturbing the flow of the exhaust gas in the exhaust flow channel to reduce pressure pulsations of the exhaust gas.

6 Claims, 3 Drawing Sheets

(51) Int. Cl.
*F01N 13/08* (2010.01)
*F01N 1/08* (2006.01)
*F01N 13/10* (2010.01)

(52) U.S. Cl.
CPC ..... *F01N 13/08* (2013.01); *F01N 13/10* (2013.01); *F01N 2210/04* (2013.01); *F01N 2230/04* (2013.01); *F01N 2260/16* (2013.01)

(58) Field of Classification Search
USPC ..... 60/322, 323, 324
See application file for complete search history.

(56) References Cited

U.S. PATENT DOCUMENTS

| | | | | |
|---|---|---|---|---|
| 6,324,838 | B1 * | 12/2001 | Stempien et al. | 60/323 |
| 2002/0017097 | A1 * | 2/2002 | Maus | 60/324 |
| 2004/0141889 | A1 * | 7/2004 | Li et al. | 422/180 |
| 2005/0045418 | A1 | 3/2005 | Choi et al. | |
| 2005/0150222 | A1 * | 7/2005 | Kalish et al. | 60/302 |
| 2007/0283687 | A1 * | 12/2007 | Host et al. | 60/302 |
| 2008/0066449 | A1 * | 3/2008 | Murata et al. | 60/285 |
| 2009/0126355 | A1 * | 5/2009 | Uchida | 60/323 |
| 2011/0041488 | A1 | 2/2011 | Bisaiji et al. | |
| 2011/0067387 | A1 * | 3/2011 | Jacques et al. | 60/299 |

FOREIGN PATENT DOCUMENTS

| | | | | |
|---|---|---|---|---|
| EP | 1 980 727 | A1 | 10/2008 | |
| JP | 1-80618 | | 5/1989 | |
| JP | 9-137720 | | 5/1997 | |
| JP | 2003083061 | A * | 3/2003 | F01N 7/10 |
| JP | 2004211639 | A * | 7/2004 | F01N 7/10 |
| JP | EP 1612383 | A2 * | 1/2006 | F01N 3/2892 |
| JP | 2007170306 | A * | 7/2007 | |
| JP | 2009-47091 | | 3/2009 | |
| JP | 2009-174343 | | 8/2009 | |
| JP | 2011-117328 | | 6/2011 | |
| WO | 98/07967 | | 2/1998 | |
| WO | WO 9807967 | A1 * | 2/1998 | F01N 3/2892 |
| WO | 00/47878 | | 8/2000 | |

OTHER PUBLICATIONS

Patent Abstracts of Japan, Publication No. 2009-047091, published Mar. 5, 2009.

Patent Abstracts of Japan, Publication No. 2009-174343, published Aug. 6, 2009.

Patent Abstracts of Japan, Publication No. 2011-117328, published Jun. 16, 2011.

International Search Report mailed Apr. 23, 2013, in corresponding International Patent Application No. PCT/JP2013/057799.

Written Opinion of the International Searching Authority mailed Apr. 23, 2013 in corresponding International Application No. PCT/JP2013/057799.

Extended European Search Report dated Dec. 18, 2015 in corresponding European Patent Application No. 13765089.1.

* cited by examiner

INTERNAL COMBUSTION ENGINE

TECHNICAL FIELD

The present invention relates to an internal combustion engine that is provided with a catalyst converter.

BACKGROUND ART

Generally, an internal combustion engine is equipped with a catalyst converter that contains a catalyst for purifying (eliminating) an exhaust gas, and the catalyst converter is provided in an exhaust gas pipe attached to an internal combustion engine main body.

The internal combustion engine that is provided with the catalyst converter is, for example, disclosed in the patent literature 1 below.

LISTING OF REFERENCE

Patent Literature

Patent Literature 1: Japanese Patent Application Laid-Open Publication (Kokai) No. 2009-174343

SUMMARY OF THE INVENTION

Problems to be Solved by the Invention

There are cases in which the phenomenon of resonance occurs due to a flow of an exhaust gas depending on the dimension or the configuration of a catalyst purifying the exhaust gas and a shape or the like of the exhaust gas pipe extending from the internal combustion engine main body to the catalyst.

The following approaches (1) to (3), for example, have been proposed for reducing the phenomenon of resonance in the catalyst converter due to the flow of the exhaust gas:

(1) To cancel (negate) the resonance noise by use of the Helmholtz resonator;

(2) To reduce the pressure pulsation of the flow of the exhaust gas by way of a rectification plate being provided within the exhaust gas pipe; and (3) To narrow down the exhaust gas pipe (i.e., to reduce an inner diameter of the exhaust gas pipe) so as to reduce the pressure pulsation of the flow of the exhaust gas.

The approaches (1) to (3) may be able to reduce the phenomenon of resonance in the catalyst converter due to the flow of the exhaust gas. However, the approaches (1) to (3) cannot be always employable because the approaches may entail the problems with the vehicle layout, the problems with manufacturing (i.e., higher manufacturing cost) or adverse influences on other facets of performance of the vehicle.

Therefore, an object of the present invention is to reduce the phenomenon of resonance in the catalyst converter due to the flow of the exhaust gas without entailing the problems with vehicle layout, problems with manufacturing (i.e., higher manufacturing cost) or adverse influences on other facets of performance.

Solution to the Problems

In order to achieve the above-mentioned object, one aspect of the present invention provides an internal combustion engine that includes an internal combustion engine main body in which a fuel chamber is formed, and a catalyst converter disposed in an exhaust flow channel of the internal combustion engine main body and provided with a catalyst for purifying the exhaust gas. The exhaust flow channel, which is upstream of the catalyst of the catalyst converter, is provided with a protuberance for disturbing the flow of the exhaust gas in the exhaust flow channel so as to reduce a pressure pulsation of the exhaust gas.

The catalyst converter may include a catalyst section for containing the catalyst, an upstream exhaust gas pipe section connected to the catalyst section for introducing the exhaust gas to the catalyst section, and a downstream exhaust gas pipe section connected to the catalyst section for discharging the exhaust gas from the catalyst section. The protuberance may be formed on an inner wall surface of an upstream end of the upstream exhaust gas pipe section.

Advantageous Effects of the Invention

The present invention can achieve an advantageous effect that is capable of reducing the phenomenon of resonance in the catalyst converter due to the flow of the exhaust gas without entailing problems with vehicle layout, problems with manufacturing (i.e., higher manufacturing cost), or adverse influences on other facets of performance.

MODE FOR CARRYING OUT THE INVENTION

Hereinafter, preferred embodiments of the present invention will be described in detail with reference to the accompanying drawings.

Figure 1:
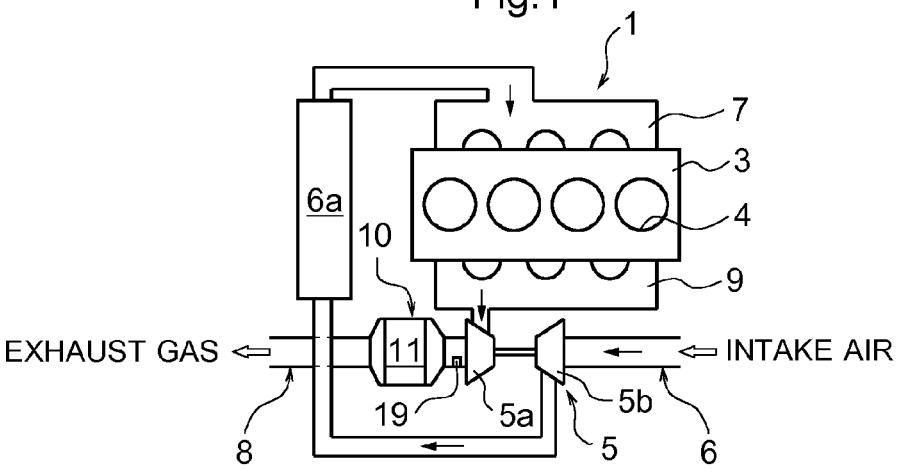
FIG. 1 illustrates a schematic diagram of an internal combustion engine (i.e., an internal combustion engine with a supercharger) according to one embodiment of the present invention.

FIG. 1 illustrates an internal combustion engine according to one embodiment of the present invention.

As shown in FIG. 1, the internal combustion engine (engine) 1 according to the present embodiment, which is to be mounted in a vehicle, is the internal combustion engine provided with a supercharger (the engine provided with a supercharger) in which a turbocharger (supercharger) 5 is mounted. In an exemplary configuration in FIG. 1, the internal combustion engine 1 is depicted as an in-line four-cylinder engine. Alternatively, the internal combustion engine 1 may be implemented as a single cylinder engine or the other type of multi-cylinder engine such as an in-line six-cylinder engine or a V-type six-cylinder engine or the like.

The internal combustion engine 1 is provided with an internal combustion engine main body 3, an intake manifold 7, an exhaust manifold 9, the turbocharger 5 and a catalyst converter 10. The internal combustion engine main body 3 (an engine main body) includes a fuel chamber 4 formed therein, and may be, for example, a diesel engine or a gasoline engine or the like. The intake manifold 7 is mounted to the internal combustion engine main body 3 to form a part of an intake flow channel 6. The exhaust manifold 9 is mounted to the internal combustion engine main body 3 to form a part of an exhaust flow channel 8. The turbocharger 5, which is arranged between the intake flow channel 6 and the exhaust flow channel 8, boosts intake gas (intake air) to be supplied to the internal combustion engine main body 3. The catalyst converter 10, which is arranged at the exhaust flow channel 8, contains the catalyst 11 for purifying the exhaust gas.

The turbocharger 5 includes a turbine 5*a* arranged in the exhaust flow channel 8 and a compressor 5*b* arranged in the intake flow channel 6. The exhaust flow channel 8, which is downstream of the turbine 5*a*, is provided with the catalyst converter 10 and a muffler or the like (not shown). The part of the intake flow channel 6, which is upstream of the compressor 5*b*, is provided with an air filter or the like (not shown). Likewise, the part of the intake flow channel 6, which is downstream of the compressor 5*b*, is provided with an intercooler 6*a* or the like.

Figure 2A:
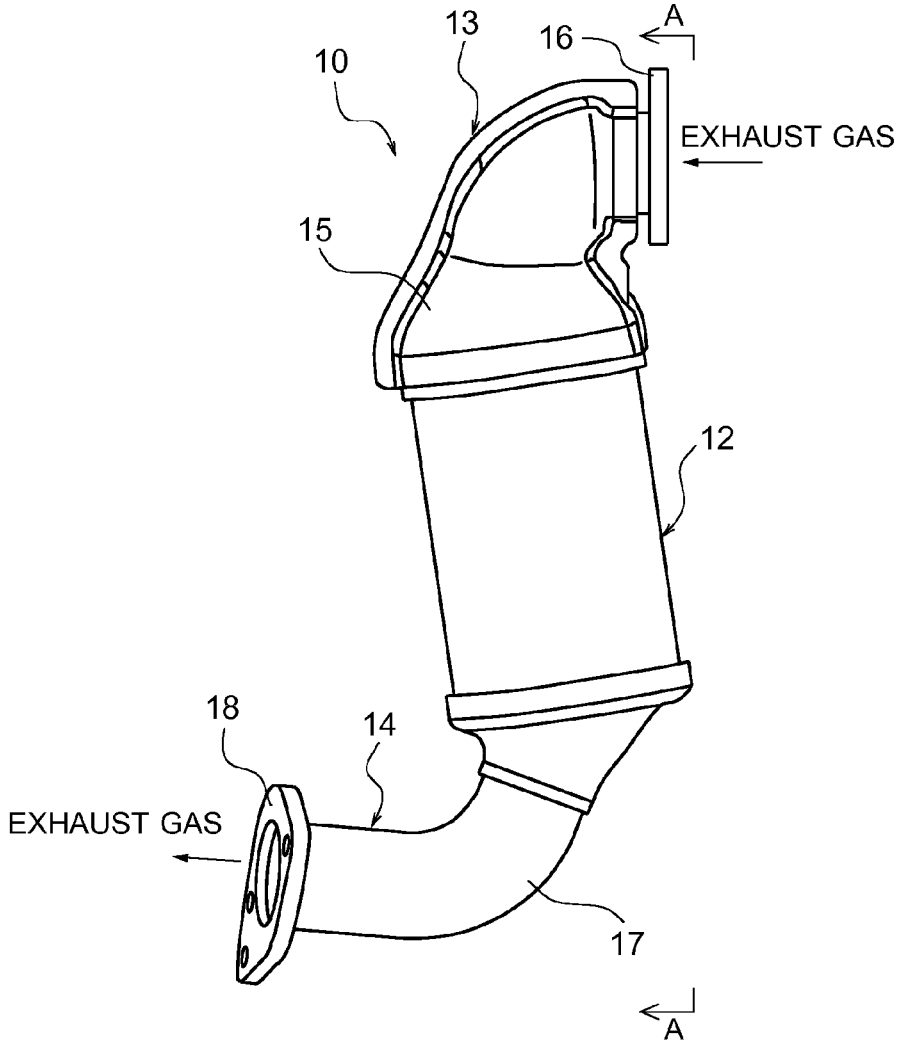
FIG. 2A illustrates a side view of the catalyst converter and FIG. 2B illustrates a drawing viewed from the A-A arrow direction in FIG. 2A

FIG. 2 illustrates the catalyst converter 10.

As shown in FIG. 2, the catalyst converter 10 is not disposed under the floor of a vehicle (underfloor). Instead, the catalyst converter 10 in FIG. 2 is a so-called manifold converter which is directly connected to the exhaust manifold 9 or alternatively connected to the exhaust manifold 9 through the turbine 5*a*.

The catalyst 11 according to the present embodiment is an oxidation catalyst (DOC) that oxidizes and detoxifies HC (hydrocarbon) and CO (carbon monoxide) in the exhaust gas. It should be noted that the catalyst 11 is not limited to the oxidation catalyst, but rather may be other catalysts such as NOx selective reduction catalyst (SCR) or NOx occlusion reduction catalyst (LNT) for reducing NOx (nitrogen oxide) in the exhaust gas.

The catalyst converter 10 is provided with a catalyst section 12, an upstream exhaust gas pipe 13 and a downstream exhaust gas pipe 14. The catalyst section 12 contains the catalyst 11 and is of a substantially cylindrical shape. The upstream exhaust gas pipe section 13 is connected to the catalyst section 12 to introduce the exhaust gas to the catalyst section 12. The downstream exhaust gas pipe section 14 is connected to the catalyst section 12 to discharge the exhaust gas from the catalyst section 12.

The upstream exhaust gas pipe section 13 is mainly configured with an exhaust gas pipe 15 (i.e., an upstream exhaust gas pipe) and a flange 16 (i.e., an upstream flange). The upstream exhaust gas pipe 15 is connected to the upstream end of the catalyst section 12. The upstream flange 16 is secured to the upstream end of the exhaust gas pipe 15 and couples the upstream end of the catalyst converter 10 (i.e., a converter inlet or an inlet of a converter) to the downstream end of the turbine 5*a* (i.e., a converter outlet or an outlet of a converter).

The downstream exhaust gas pipe section 14 is mainly configured with an exhaust gas tube 17 (i.e., a downstream exhaust gas pipe) and a flange 18 (i.e., a downstream flange). The downstream exhaust gas pipe 17 is connected to the downstream end of the catalyst section 12. The downstream flange 18 is secured to the downstream end of the exhaust gas pipe 17. The flange 18 connects the downstream end of the catalyst converter 10 (i.e., a converter outlet) to the exhaust gas pipe at the downstream side (not shown).

In the internal combustion engine 1 according to the present embodiment, a protuberance 19 is disposed in the exhaust flow channel 8 between the turbine 5*a* and the catalyst 11 of the catalyst converter 10 for disturbing a flow of an exhaust gas in the exhaust flow channel 8 so as to reduce the pressure pulsation of the exhaust gas (as shown in FIG. 1).

More particularly, the protuberance 19 is formed in an inner diameter section 30 of the flange 16 which couples the upstream end of the catalyst converter 10 to the downstream end of the turbine 5*a*. In other words, the protuberance 19 is arranged on the inner wall surface of the upstream end of the upstream exhaust gas pipe section 13 in the catalyst converter 10.

Figure 2B:
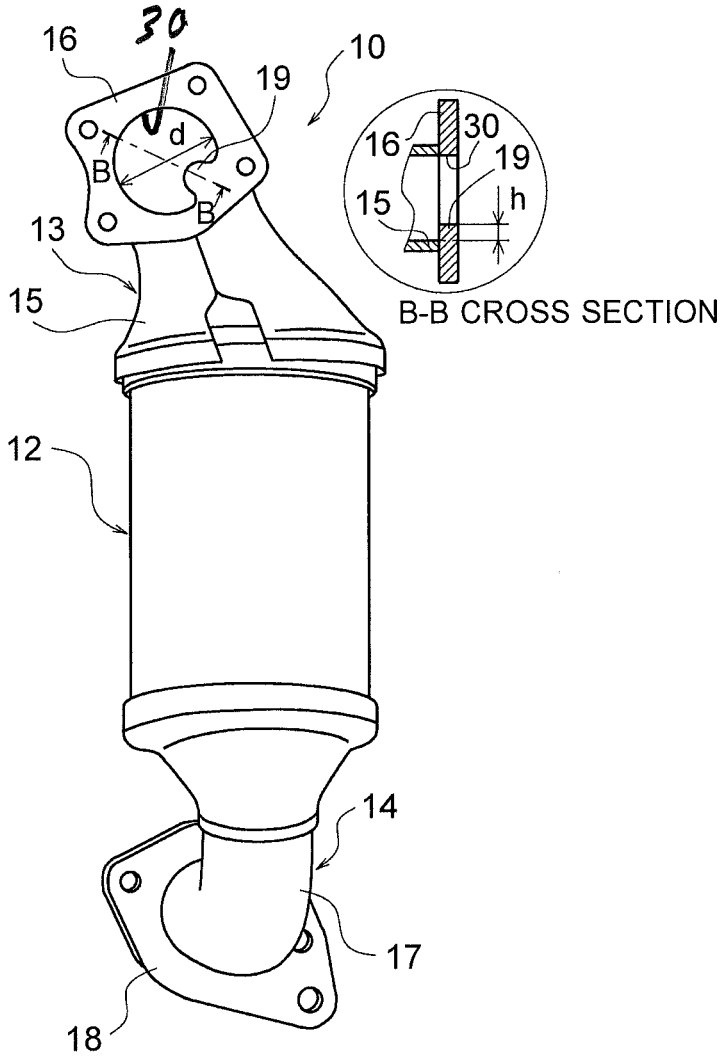

It may be contemplated that the dimension and the location of the protuberance 19 can be appropriately determined according to the results of an experimentation or a simulation or the like (of the outlet noise of the converter) in consideration of, inter alia, influences on other facets of performance (such as an increase in an engine exhaust pressure). For example, the height h of the protuberance 19 is set to approximately 0.25 times of the inner diameter d of the flange 16 (as shown in FIG. 2B).

Hereinafter, a function and an effect of the internal combustion engine 1 according to the present embodiment will be described.

The experiment conducted towards the present invention has proved the following facts (1) to (5):

(1) The generation of resonance noise due to the flow of the exhaust gas does not depend on the engine speed.

(2) The generation of resonance noise also does not depend on the magnitude of the pressure loss in the catalyst converter.

(3) The resonance noise is generated in association with the boost pressure (i.e., the gas flow rate) of the turbocharger and generated when the boost pressure is high.

(4) The resonance noise due to the flow of the exhaust gas is generated in association with the volume of the catalyst section of the catalyst converter and generated when the volume of the catalyst section is larger than the prescribed value.

(5) The pressure pulsation of the flow of the exhaust gas upstream of the catalyst converter is amplified (i.e., resonated) in the catalyst section of the catalyst converter so as to generate an abnormal noise (i.e., resonance noise).

It can be presumed that the resonance noise due to the flow of the exhaust gas is generated according to the same principle as the phenomenon in which blowing a lip of a drink bottle makes a noise (i.e., the phenomenon of resonance).

Taking the above fact into consideration, in the internal combustion engine 1 according to the present embodiment, the protuberance 19 is disposed in the exhaust flow channel 8 between the turbine 5*a* and the catalyst 11 of the catalyst converter 10 in order to proactively disturb the flow of the exhaust gas in the exhaust flow channel 8 thereby reducing pressure pulsation of the flow of the exhaust gas.

The exhaust gas discharged from the turbine 5*a* is associated with the pressure pulsation of the flow of the exhaust gas depending on the number of turbine blades of the turbine 5*a*. When the pressure pulsation of the flow of the exhaust gas coincides with the resonance frequency of the catalyst section 12 of the catalyst converter 10, the resonance noise is generated in the catalyst section 12 of the catalyst converter 10.

Under these circumstances, the protuberance 19 provided in the exhaust flow channel 8 between the turbine 5*a* and the catalyst 11 of the catalyst converter 10 can disturb the cycle of the pressure pulsation (i.e., frequency) of the flow of the exhaust gas so as to change the cycle of the pressure pulsation of the flow of the exhaust gas. Accordingly, the undesirable resonance can be avoided in the catalyst section 12 of the catalyst converter 10 due to the flow of the exhaust gas thereby suppressing the abnormal noise (i.e., the resonance noise) being generated in the catalyst converter 10.

Also, the protuberance 19 provided in the exhaust flow channel 8 between the turbine 5*a* and the catalyst 11 of the catalyst converter 10 can proactively generate the Karman vortex. Allowing the Karman vortex to be confluent into the flow of the exhaust gas in the exhaust flow channel 8 can disturb the pulsation component (i.e., the pulsation amplitude) of the pressure pulsation in the flow of the exhaust gas generated at the turbine blades thereby reducing the pulsation component of the pressure pulsation in the flow of the exhaust gas, which entails the phenomenon of resonance in the catalyst converter 10. Reducing the pulsation component of the pressure pulsation in the flow of the exhaust gas can avoid the resonance in the catalyst section 12 of the catalyst converter 10 due to the flow of the exhaust gas thereby suppressing the abnormal noise (i.e., the resonance noise) being generated in the catalyst converter 10.

Adding the protuberance 19 to the catalyst converter 10 cannot affect (change) the appearance of the catalyst converter 10, thus is free from entailing the problems with vehicle layout. Also, relatively small-sized protuberance 19 is sufficient to be added to the catalyst converter 10 as long as the flow of the exhaust gas can be slightly disturbed, thus is free from entailing the problems with manufacturing (i.e., higher manufacturing cost) and adverse influences on other facets of performance (e.g., an increase in the engine exhaust pressure).

Furthermore, according to the internal combustion engine 1 of the present embodiment, the protuberance 19 is disposed in the inner diameter section 30 of the flange 16 which connects the upstream end of the catalyst converter 10 to the downstream end of the turbine 5*a*. In other words, the protuberance 19 is arranged on the inner wall surface of upstream end of the upstream exhaust gas pipe section 13 in the catalyst converter 10. The reason why the protuberance 19 is formed at the upstream end of the upstream exhaust gas pipe section 13 (the flange 16) is to allow easier forming or fabrication of the protuberance 19 compared to the case that the protuberance 19 is disposed in the middle of the upstream exhaust gas pipe 15 or the like.

Figure 3:
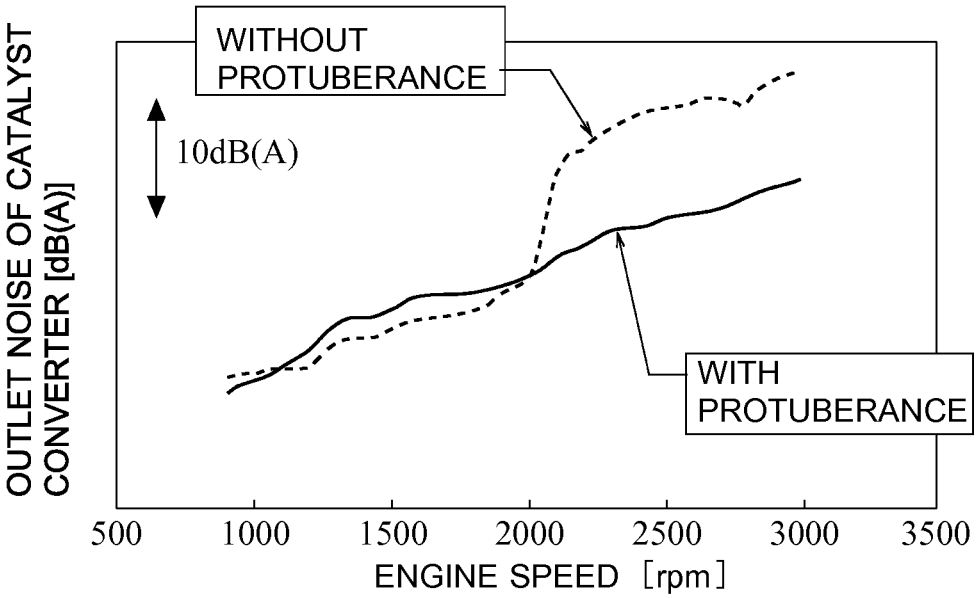
FIG. 3 illustrates measurement results of the outlet noise of the catalyst converter.

FIG. 3 illustrates the measurement results of an outlet noise of the catalyst converter.

As appreciated from FIG. 3, if no protuberance 19 is used, then the outlet noise of the catalyst converter rapidly becomes larger to generate the resonance after the engine speed exceeds 2000 rpm. On the other hand, as appreciated from FIG. 3, if the protuberance 19 is used, then the outlet noise of the catalyst converter does not rapidly become larger after the engine speed exceeds 2000 rpm. Also as appreciated from FIG. 3, if the protuberance 19 is used, the outlet noise of the catalyst converter can be reduced by approximately 10 dB (A) in the area in which the engine speed exceeds 2000 rpm compared to the case without protuberance.

To summarize the foregoing, according to the internal combustion engine 1 of the present invention, the phenomenon of resonance of the catalyst converter 10 due to the flow of the exhaust gas can be reduced without entailing the problems with vehicle layout, problems with manufacturing (i.e., higher manufacturing cost) or adverse influences on other facets of performance.

The preferred embodiments according to the present invention have been described in the foregoing. It should be noted, however, that the present invention is not limited to the above described embodiments, and can employ other various embodiments.

Figure 4:
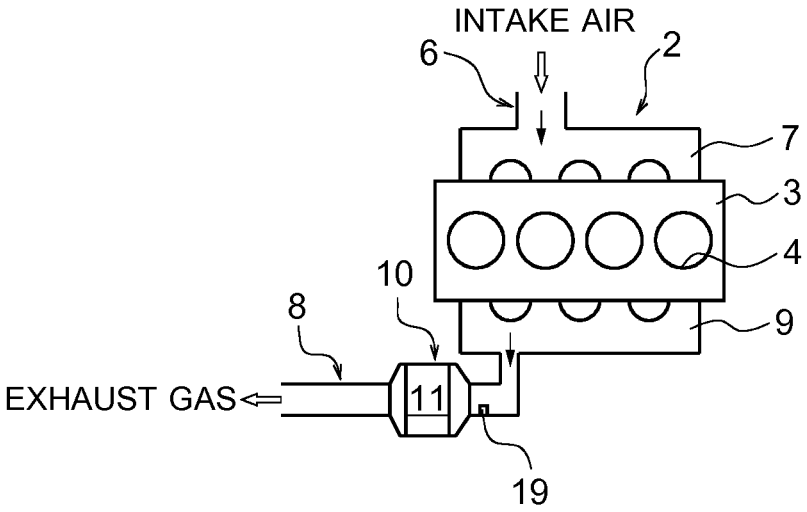
FIG. 4 illustrates a schematic diagram of another internal combustion engine (i.e., a naturally aspirated internal combustion engine) according to another embodiment of the present invention.

For example, although the present invention is applied to the internal combustion engine with the supercharger (turbocharger) in the above described embodiments, the present invention can be applied to a naturally aspirated internal combustion engine (i.e., naturally aspirated engine). When the present invention is applied to the naturally aspirated internal combustion engine, as shown in the internal combustion engine 2 in FIG. 4, the protuberance 19 is disposed in the exhaust flow channel 8 upstream of the catalyst 11 of the catalyst converter 10 for disturbing the flow of the exhaust gas in the exhaust flow channel 8 so as to reduce the pressure pulsation of the exhaust gas. In this case also, the catalyst converter 10 including the protuberance 19 may be employed in an inner diameter section of the flange 16 which connects the outlet of the exhaust manifold to the inlet of the converter, thus, it can reduce the phenomenon of resonance of the catalyst converter due to the flow of the exhaust gas without entailing the problems with vehicle layout, the problems with manufacturing (i.e., higher manufacturing cost) or adverse influences to other facets of performance in the similar way as the above described embodiments.

More particularly, the exhaust gas discharged from the internal combustion engine main body 3 is associated with the pressure pulsation of the flow of the exhaust gas depending on the number of fuel chamber(s) 4 of the internal combustion engine main body 3. When the pressure pulsation of the flow of exhaust gas coincides with the resonance frequency of the catalyst section 12 of the catalyst converter 10, the resonance noise is generated in the catalyst section 12 of the catalyst converter 10. Under these circumstances, use of the protuberance 19 in the exhaust flow channel 8 upstream of the catalyst 11 of the catalyst converter 10 can disturb the cycle of the pressure pulsation (i.e., frequency) of the flow of the exhaust gas so as to change the cycle of the pressure pulsation of the flow of the exhaust gas. Accordingly, the undesirable resonance can be avoided in the catalyst section 12 of the catalyst converter 10 due to the flow of the exhaust gas thereby suppressing the abnormal noise (i.e., the resonance noise) being generated in the catalyst converter 10. Also, the protuberance 19 provided in the exhaust flow channel 8 upstream of the catalyst 11 of the catalyst converter 10 can disturb the pulsation component (i.e., the pulsation amplitude) of the pressure pulsation in the flow of the exhaust gas generated in the fuel chamber 4 of the internal combustion engine main body 3 thereby reducing the pulsation component of the pressure pulsation in the flow of the exhaust gas. Reduction of the pulsation component of the pressure pulsation in the flow of the exhaust gas can avoid the resonance in the catalyst section 12 of the catalyst converter 10 due to the flow of the exhaust gas thereby suppressing the abnormal noise (i.e., the resonance noise) being generated in the catalyst converter 10.

Yet alternatively, the internal combustion engine 1 (i.e., the internal combustion engine with the supercharger) shown in FIG. 1 may be provided with the protuberance 19 on an inner wall surface downstream of the turbine 5*a*, in replacement of the protuberance 19 being provided in the inner diameter section of the flange 16 which connects the outlet of the turbine to the inlet of the converter. Furthermore, the internal combustion engine 2 (i.e., the naturally aspirated internal combustion engine) shown in FIG. 4 may be provided with the protuberance 19 on an inner wall surface downstream of the exhaust manifold 9 (i.e., the outlet of the manifold). With such configuration, it can reduce the phenomenon of resonance of the catalyst converter due to the flow of the exhaust gas without entailing the problems with vehicle layout, the problems with manufacturing (i.e., higher manufacturing cost) or adverse influences to other facets of performance in the similar way as the above described embodiments.

EXPLANATION OF REFERENCE NUMERALS

1 internal combustion engine (internal combustion engine with the supercharger)
2 internal combustion engine (naturally aspirated internal combustion engine)
3 internal combustion engine main body
4 fuel chamber
8 exhaust flow channel
10 catalyst converter (manifold converter)
11 catalyst
12 catalyst section
13 upstream exhaust gas pipe section
14 downstream exhaust gas pipe section
19 protuberance

What is claimed is:

1. An internal combustion engine comprising:
an internal combustion engine main body in which a fuel chamber is formed;
an exhaust manifold mounted to the internal combustion engine main body;
a turbine of a turbocharger which is arranged at a downstream side of the exhaust manifold;
a catalyst converter attached to a downstream end of the turbine and provided with a catalyst for purifying exhaust gas, and a catalyst section for containing the catalyst;
a flange secured at an upstream end of the catalyst converter and coupled to the downstream end of the turbine; and
a protuberance provided in an inner diameter section of the flange and configured to change a cycle of a pressure pulsation of flow of the exhaust gas to avoid resonance in the catalyst section due to the flow of the exhaust gas,
wherein the flange is a plate-like member protruding radially outside relative to the upstream end of the catalyst converter, and has a first thickness measured in a direction of the flow of the exhaust gas,
the protuberance is formed from the flange itself and of flange material, and has a second thickness measured in a direction of the flow of the exhaust gas, and
the second thickness of the protuberance is equal to the first thickness of the flange at said inner diameter section.

2. The internal combustion engine according to claim 1, wherein the catalyst converter includes:
an upstream exhaust gas pipe section connected to the catalyst section for introducing the exhaust gas to the catalyst section; and
a downstream exhaust gas pipe section connected to the catalyst section for discharging the exhaust gas from the catalyst section,
wherein the flange is secured at an upstream end of the upstream exhaust gas pipe section.

3. The internal combustion engine according to claim 1, wherein the internal combustion engine is a diesel engine or a gasoline engine.

4. An internal combustion engine, comprising:
an internal combustion engine main body in which a fuel chamber is formed;
an exhaust manifold mounted to the internal combustion engine main body;
a catalyst converter attached to a downstream end of the exhaust manifold and provided with a catalyst for purifying exhaust gas, and a catalyst section for containing the catalyst;
a flange secured at an upstream end of the catalyst converter and coupled to the downstream end of the exhaust manifold; and
a protuberance provided in an inner diameter section of the flange and configured to change the cycle of a pressure pulsation of the flow of the exhaust gas to avoid resonance in the catalyst section of the catalyst converter due to the flow of the exhaust gas,
wherein the flange is a plate-like member protruding radially outside relative to the upstream end of the catalyst converter, and has a first thickness measured in a direction of the flow of the exhaust gas,
the protuberance is formed from the flange itself and of flange material, and has a second thickness measured in a direction of the flow of the exhaust gas, and
the second thickness of the protuberance is equal to the first thickness of the flange at said inner diameter section.

5. The internal combustion engine according to claim 4, wherein the catalyst converter includes:
an upstream exhaust gas pipe section connected to the catalyst section for introducing the exhaust gas to the catalyst section; and
a downstream exhaust gas pipe section connected to the catalyst section for discharging the exhaust gas from the catalyst section,
wherein the flange is secured at an upstream end of the upstream exhaust gas pipe section.

6. The internal combustion engine according to claim 4, wherein the internal combustion engine is a diesel engine or a gasoline engine.

* * * * *